US006644088B1

(12) United States Patent
Ruescher et al.

(10) Patent No.: US 6,644,088 B1
(45) Date of Patent: Nov. 11, 2003

(54) APPARATUS FOR FLANGING METAL SHEETS

(75) Inventors: Artur Ruescher, Cologne (DE); Bruno Strausfeld, Berghelm (DE); Ralph Hoffstadt, Frechen (DE)

(73) Assignee: Ford Motor Company, Dearborn, MI (US)

( * ) Notice: Subject to any disclaimer, the term of this patent is extended or adjusted under 35 U.S.C. 154(b) by 0 days.

(21) Appl. No.: 10/063,872

(22) Filed: May 21, 2002

(51) Int. Cl.[7] ..... B21D 11/00
(52) U.S. Cl. ..... 72/312; 29/243.58; 72/306
(58) Field of Search ..... 72/312, 306, 386, 72/293, 387; 29/243.5, 243.57, 243.58

(56) References Cited

U.S. PATENT DOCUMENTS 5,150,508 A * 9/1992 St. Denis ..... 29/463
5,454,261 A 10/1995 Campian
6,098,440 A * 8/2000 Gorgen ..... 72/312
6,182,492 B1 2/2001 Raffin et al.
6,446,478 B1 * 9/2002 Muller ..... 72/306

* cited by examiner

*Primary Examiner*—Allen Ostrager
*Assistant Examiner*—John S Goetz
(74) *Attorney, Agent, or Firm*—Raymond L. Coppiellie

(57) ABSTRACT

The present invention provides a flanging apparatus for metal sheets for use with metal sheets of the body structure in vehicle manufacturing, with a base frame, with a flanging bed movable up and down, and with flanging jacks movable into the work area of the flanging bed. The invention consists of the fact that a flanging tool has the main, workpiece-specific components, in particular the flanging bed and flanging jacks, and is arranged in the base frame as an exchangeable unit.

11 Claims, 3 Drawing Sheets

APPARATUS FOR FLANGING METAL SHEETS

BACKGROUND OF INVENTION

1. Field of the Invention

This invention relates generally to forming materials and more particularly to hemming or flanging of metal sheets. A hemming or flanging process forms a flange on the edge of a metal sheet. Folding the formed flange onto the metal sheet conceals the cut edge and completes the hem.

2. Description of the Related Art

A device for flanging metal sheets is disclosed in DE 19801561. In this patent, an electromechanical operation of the flanging bed for the displacement stroke between the flanging jacks and the operating stroke is proposed. The flanging jacks are placed in a pivoting manner at the machine frame and are moved by means of pneumatic cylinders. For a tool change, the flanging jacks, flanging bed, and hold-down clamps must be individually assembled, disassembled, and adjusted. These operations are very time consuming and lead to very long downtimes when a change is required. Maintenance work requires the same laborious operations and the flanging device remains inoperative during any preventive maintenance procedures.

Electro-mechanical drives have also been used to improve upon some of the noise characteristics associated with the hydraulic drives of flanging devices. DE 19747291 discloses a device for folding metal sheets that performs the work stroke by means of pneumatic air cushions with the air cushions acting directly on the ram for the folding process. A disadvantage of this design is that the folding device is a component of the drive unit thereby involving the drive unit during a tool change.

There exists a need for a hemming/flanging device that reduces maintenance time and simplifies the flanging tool change procedures.

SUMMARY OF INVENTION

Accordingly, the present invention overcomes the problems of the prior art by providing an apparatus for flanging together metal sheets in a manufacturing process. The apparatus comprises a base frame, a flanging bed operative to move from a first position to a second position, and a flange drive operative to move said flanging bed. A flanging jack is disposed upon the flanging bed. The apparatus further includes an exchangeable flanging tool, the tool including the flanging bed and flanging jack, mounted on the base frame as well as a flanging tool base including slidable members therein. The exchangeable flanging tool is disposed on the slidable members such that a first exchangeable flanging tool can be slidably removed and replaced by slidably moving a second exchangeable flanging tool into place.

It is advantage of the current invention to simplify drive maintenance procedures by incorporating the main flanging tool-specific components, especially the flanging bed and the flanging jacks, into the flanging tool and mounting the tool on the base frame as an exchangeable unit.

Furthermore, it is an advantage of the current invention to establish the flanging tool as an independent, transportable unit. The tool maintains its workpiece specific settings and adjustments regardless of whether it is located in the flanging device. Thus, for tool maintenance and tool change, the flanging tool can be quickly and easily removed from the flanging device and replaced by another flanging tool.

These and other advantages of the present advantage will become readily apparent in the figures, detailed description, and claims that follow.

DETAILED DESCRIPTION

Figure 1:
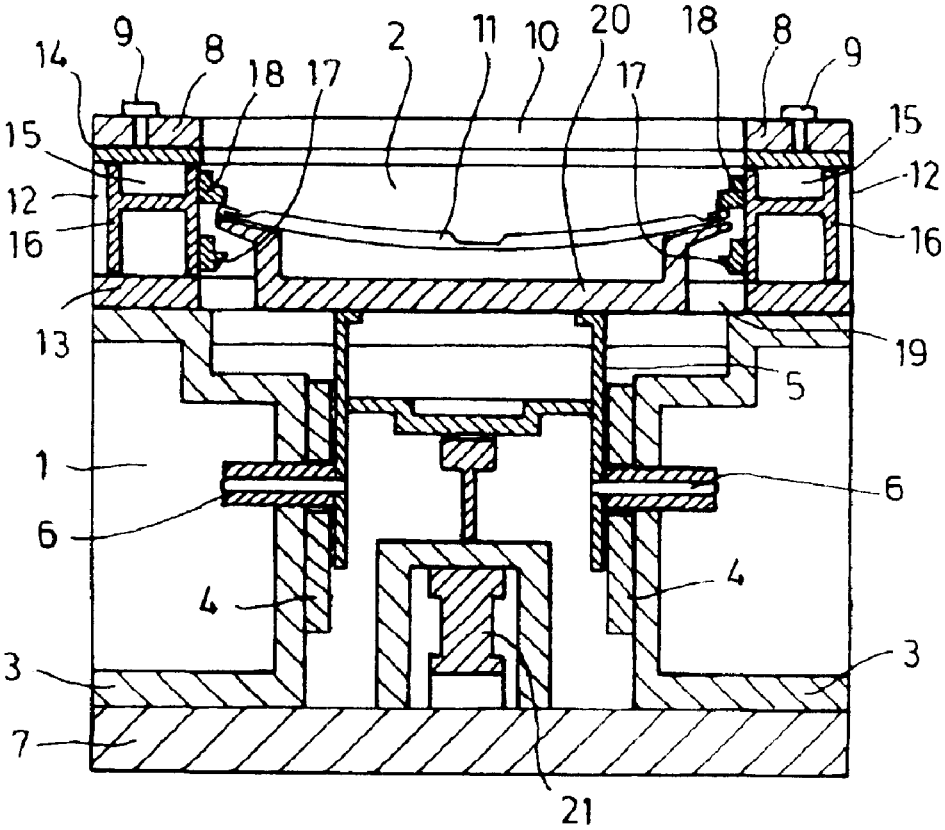
FIG. 1 is a side cross sectional view of the flanging apparatus according to the present invention.

FIG. 1 illustrates the flanging device according to the present invention, comprising two main components: the main base frame 1 and the flanging tool 2. The main base frame 1 includes a base frame 3 as the central element for receiving flanging lifters 5 for the flanging movement led with slide plates 4. A service (or maintenance) peg 6 for the flanging lifters 5 allows fixing the flanging lifters 5 during maintenance actions. A bottom plate 7 is designed for attaching the flanging device to the floor. In the upper part of the main base frame 1, the base frame 3 is closed off with a frame cover plate 8. The frame cover plate 8 houses tensioning and centering units 9 for the flanging tool 2. An opening 10 in the frame cover plate 8 is used to load the flanging tool 2 with the workpiece 11. A piercing tool pickup 12 for the receiving the flanging tool 2 in the main base frame 1 is situated between the base frame 3 and the frame cover plate 8. Thus, the flanging tool 2 can be pushed in and out of the base frame from any side depending on the tool-exchange time required. As will be described in more detail below, the flanging tool 2 can be tensioned in the base frame as a manual bolted connection, or fully automatically by means of electro-mechanical tensioning elements. Exchange tables are situated in the base frame on one or both sides of the tool pickup to receive the flanging tool during the exchange. There, the flanging tools can be serviced directly, or they can be prepared for further transportation. The devices for the removal or insertion of the flanging tools are also located in the exchange tables.

The flanging tool 2 consists of a frame comprising a base plate 13, a cover plate 14, and spacers 15 located on the four corners of the tool frame. The alignment and the attachment of the flanging tool 2 in the main base frame 1 occur by means of tensioning and centering units 9. Movable flanging slides 16 include 45° flanging jacks 17 for pre-flanging and 90° flanging jacks 18 for finish-flanging and are placed between the base plate 13 and the cover plate 14. In its center, the base plate 13 has an aperture 19 of at least the same size as the flanging bed 20 through which the flanging tool can be loaded with the workpiece from above. The flanging bed 20, which receives the workpiece 11, is placed loosely in the flanging tool 2 and tightly attached to the flanging lifters 5. During the flanging process, the workpiece is held onto the flanging bed 20 by a hold-down clamp thereby allowing the hold-down clamps to be built into the flanging tool, or allowing the function of the hold-down clamp to be fully taken over by a robot arm, which also loads the workpiece on to the flanging device. Also during the flanging process, the flanging bed is led by the flanging lifters 5 and also moved by a power stroke device. A flanging drive device 21 acting on the flanging lifters 5 is placed on the bottom plate 7 of the main base frame 1. The flanging lifter 5 is situated in the base frame 3, and transmits the propulsion force to the flanging bed 20, the flanging lifter 5 to be activated hydraulically, pneumatically or electromechanically. The flanging bed 20 is tightly connected with the flanging lifter 5, and the connection is further secured with a threaded connection or an automatic interlock. The flanging bed 20 is centered during the first stroke of the flanging lifter following the installation of the flanging tool.

Figure 2:
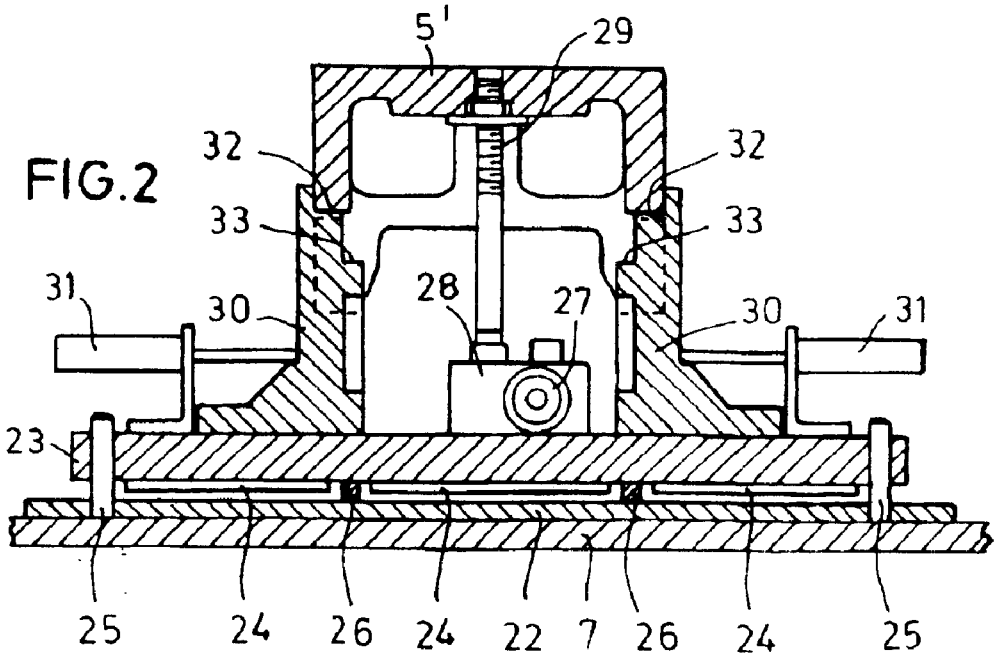
FIG. 2 is a side cross sectional view of a flanging drive with compressed-air cushions according to the present invention.

An electro-pneumatic drive variant with a spindle stroke device, shown in detail in FIG. 2, is provided for the flanging drive device 21. The entire construction of the flanging drive 21 is modular so that flange drive unit 21 can be exchanged within the main base frame 1 easily. To that end, the flanging drive 21 has a flanging drive base plate 22, which is bolted to the base plate 7 of the main base frame 1. Compressed-air cushions 24 are disposed between the flanging drive base plate 22 and an operating stroke base plate 23. The cushions 24 execute the smaller work stroke for the flanging process by lifting the operating stroke base plate 23. A double post guide 25 is provided for the exact alignment of the flanging drive base plate 22 and the operating stroke base plate 23. A uniform distance of the two plates in rest position is guaranteed by spacers 26. In this way, the electrically driven spindle-stroke device provides the large displacement stroke between the flanging jacks. The one or several compressed-air cushions (pads) provides a means for actuating the small work stroke for the flanging process, whereby the spindle stroke device is protected by a locking mechanism during its working stroke against any spindle damage. The spindle jack, resting upon the flanging bed, is a component of the spindle stroke device and the entire spindle stroke device, including its locking mechanism, is placed on the compressed-air cushions and moves along with each work stroke. Since the compressed-air cushions are located on the floor of the base frame, the flanging jack can be of considerable height. The resulting long guide tracks between the flanging lifter and the base frame ensure the guidance of the flanging lifter even during alternating load-application points, due to the workpiece tolerances or different flanging tools.

The displacement stroke between the flanging jacks 17 is executed through the spindle advance device 29 located on the working stroke base plate 23. An electric motor 27, a transmission 28 and a driven spindle 29 cooperatively lift or lower the flanging lifter 5" according to the desired displacement stroke. For the duration of the work stroke, during which great forces are produced, the spindle 29 is locked into a fixed position by a locking mechanism. The locking mechanism consists of two or more spacer blocks 30 mounted in a movable manner on the work stroke plate 23, which, by means of positioning devices 31 are pushed under the flanging lifter 5" in such a way that they support either an upper shoulder 32 or a lower shoulder 33 of the flanging lifter 5" and thus transmit the main forces of the work stroke. The interface points of the transmission of the drive loads are modular so that the same drives can be used without any changes for various flanging tools.

Figure 3:
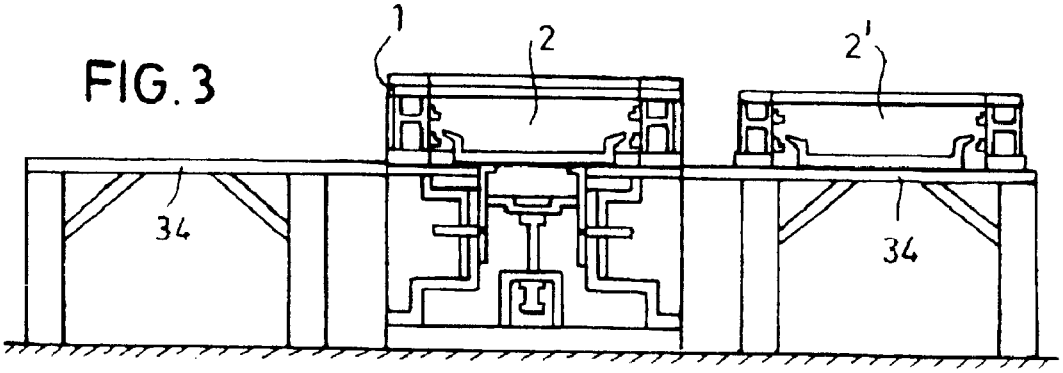
FIG. 3 is a side view of a flanging apparatus according to the invention with change tables.

FIG. 3 shows a view of the flanging device with change tables 34. The change tables 34 permit the flanging tools 2 to shift to the right or to the left from the main base frame 1. While a flanging tool 2 is in the main base frame 1 and the flanging device is operating, a flanging tool 2" located on the change table 34 can be serviced, adjusted or prepared for use. The necessary work on the first flanging tool is performed outside the flanging device, while the flanging device can process a different workpiece with another flanging tool. After the new or repaired flanging tool has been inserted and secured in the base frame, the flanging device is again quickly ready for use.

Figure 4A:
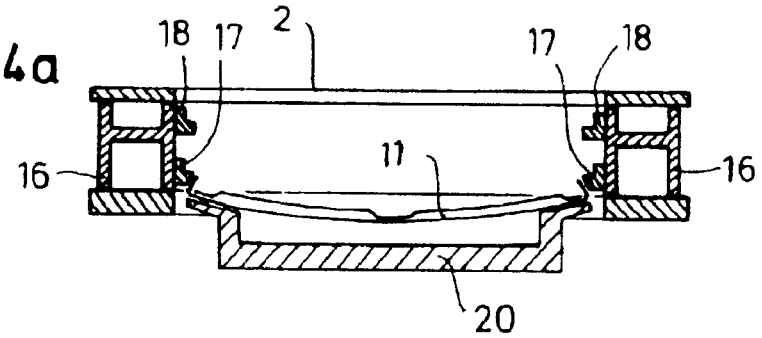
FIGS. 4*a*–4*c* are views of the flanging tool of the present invention during a flanging operation on the upper flanging jacks.
Figure 4B:
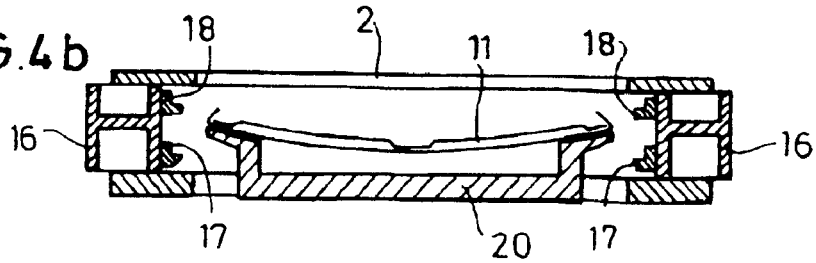
Figure 4C:
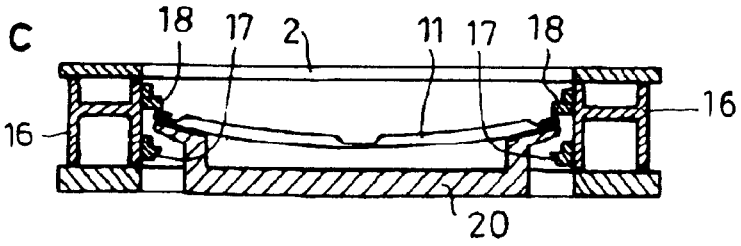

FIGS. 4*a*–4*c* show various work steps in the flanging device 2. FIG. 4*a* shows the step of pre-flanging of the workpiece 11. The flanging bed 20 is located at the height of the 45° flanging jacks 17, located on the flanging slides 16. By releasing a small flanging stroke, pre-flanging of the workpiece 11 is activated.

FIG. 4*b* shows the flanging tool 2 during the displacement stroke. The flanging slides 16 are driven outwardly and thereby all the flanging jacks 17, 18 are removed from the work area of the flanging bed 20. The spindle stroke device lifts the flanging bed 20 to the finish-flanging position, as shown in FIG. 4*c*. There, the flanging slides 16 return the flanging jacks 17, 18 into the work area of the flanging bed 20. By executing the work stroke, the workpiece 11 is finish-flanged on the 90° flanging jacks 18.

Figure 5:
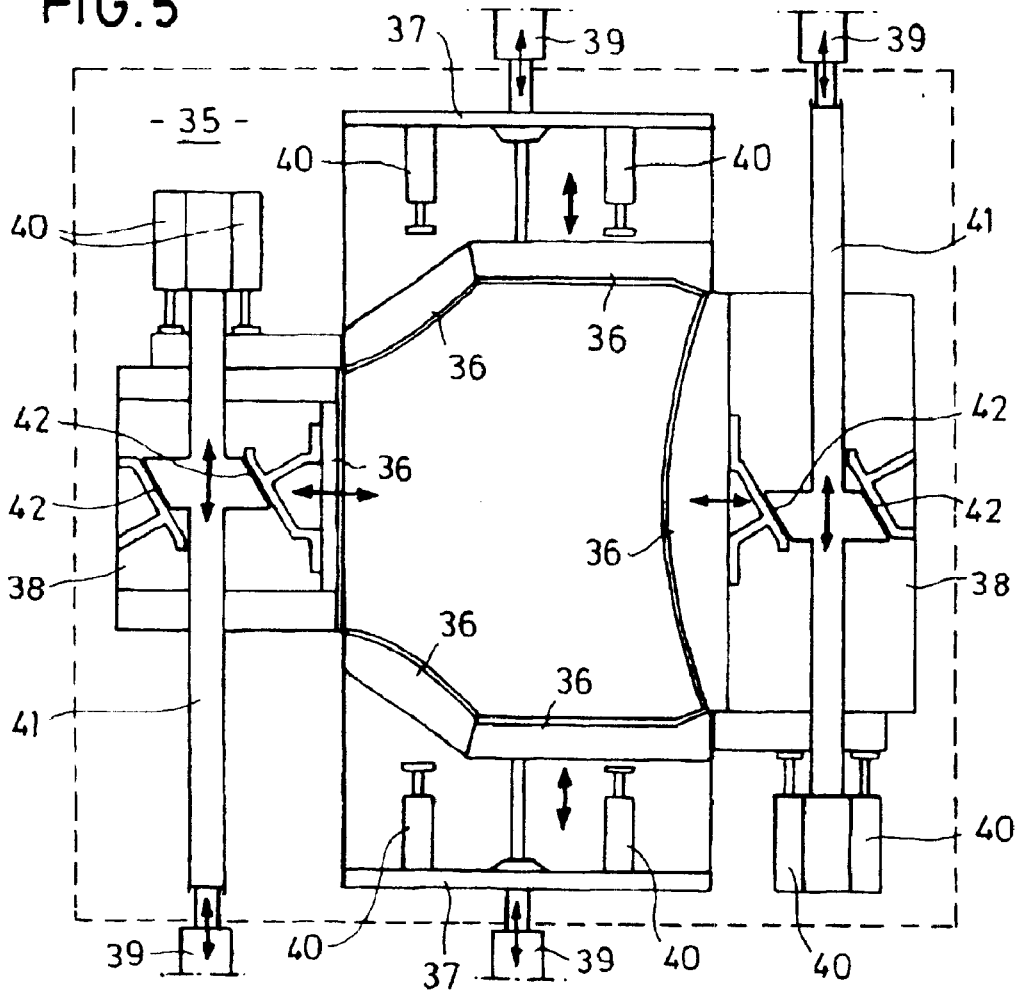
FIG. 5 is a top view of a flanging tool of the present invention during a displacement stroke.

FIG. 5 shows a top plan view of the flanging sliders and their layout in a flanging tool 35 according to the present invention. Flanging jacks 36, which follow the contour of the workpiece 11, can be moved in the operating area of the flanging bed, and are attached to flanging sliders 37, 38. The drives 39 of the flanging jacks 36 are arranged on the sides of the frame cover plate 8 and transmit a compressive force directly onto the flanging tool 35. For the laterally placed flanging sliders 37, this driving force can be converted in a direct, straight-line movement in the operating area of the flanging bed 20. A retrieving mechanism 40 is provided for the return of the flanging jacks 36 that produces the return forces by means of pressure springs, compressed-air cylinders or other. Because of this type of energy transfer, no additional connections between the flanging sliders and the flanging drives are required during the assembly of the flanging tool; the positioning of the flanging tool in the established assembly position in the base frame is sufficient.

The flanging sliders 38 located on the front side move in a direction perpendicular to the drives 39. The drives 39 first act on auxiliary sliders 41 which produce the required movement of the flanging sliders 38 in the operating area of the flanging bed 20 via an inclined plane 42. The retrieving mechanism 40 is provided for the return of the flanging sliders 38.

Figure 6:
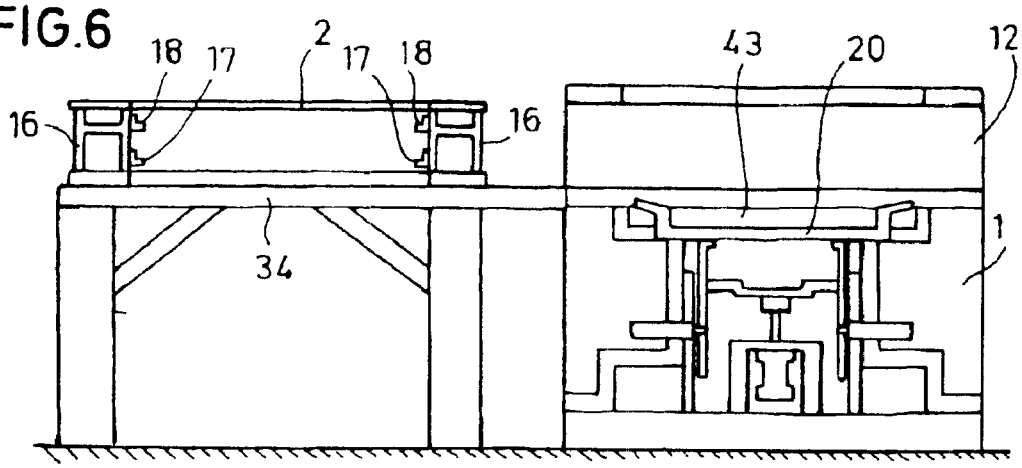
FIG. 6 is a side view of a flanging tool during the flanging operation on the lower flanging jacks.

FIG. 6 shows, for simple service actions on the flanging tool 2, the flanging bed 20 in service position 43 lowered in the main base frame 1, and then a flanging tool 2 without the flanging bed 20 being disposed on the change table 34. A position sunk in the main base frame 1 is provided for the flanging bed 20 for the maintenance of the flanging jacks allowing the flanging tool to be removed from the base frame without the flanging bed. This facilitates the access to the flanging jacks 17, 18 and flanging slides 16, and allows for quick maintenance work. If the flanging tool 2 is again taken in the main base frame 1, the flanging device is quickly ready for work. As can seen, it is an advantage of the present invention to establish the flanging tool as an independent, transportable unit. The tool maintains its workpiece specific settings and adjustments regardless of whether it is located in the flanging device. Thus, for tool maintenance and tool change, the flanging tool can be quickly and easily removed from the flanging device and replaced by another flanging tool. The necessary work on the first flanging tool is performed outside the flanging device, while the flanging device can process a different workpiece with another flanging tool. After the new or repaired flanging tool has been inserted and secured in the base frame, the flanging device is again quickly ready for use.

It will be realized, however, that the foregoing specific embodiments have been shown and described for the purposes of illustrating the functional and structural principles of the invention and is subject to change without departure from such principles. Therefore, this invention includes all modifications encompassed within the scope of the following claims.

What is claimed is:

1. An apparatus for flanging together metal sheets in a manufacturing process, said apparatus comprising:

a base frame;

a flanging bed operative to move from a first position to a second position;

a flange drive device secured to said base frame and operative to move said flanging bed, said flanging drive device including a flanging lifter disposed upon spacing blocks secured to said base frame;

a flanging jack disposed upon said flanging bed;

an exchangeable flanging tool, said tool including said flanging bed and said flanging jack, mounted on the base frame;

a spindle stroke device operative to displace the flanging bed from a first position through a work stroke;

a cushion system operative to produce a flanging work stroke; and a flanging tool base including slidable members therein, said exchangeable flanging tool being disposed on said slidable members such that a first exchangeable flanging tool can be slidably removed and replaced by slidably moving a second exchangeable flanging tool into place.

2. The apparatus of claim 1, wherein the spindle stroke device is disposed upon said cushion system.

3. The apparatus of claim 1, wherein said base frame has a tool pickup opening through which said flanging tool can be positioned on and removed from said base frame.

4. The apparatus of claim 1, further including a change table configured to receive said flanging tool and disposed adjacent to said base frame.

5. The apparatus of claim 1, further comprising a flanging slider and an auxiliary slider adapted to position said flanging tool.

6. The apparatus of claim 1, wherein said flanging tool further comprises a base plate and a cover plate cooperating to form a locator detente point during flanging tool exchange.

7. The apparatus of claim 6, wherein said base plate has an opening of at least the size of the flanging bed and the cover plate has an opening of at least the size of a workpiece.

8. The apparatus of claim 7, wherein said flanging bed is adapted to be locked in position during a flanging tool exchange.

9. The apparatus of claim 1, wherein the base frame has a predetermined position for receiving the flanging bed therein, wherein the flanging tool can be removed independent of said flanging bed.

10. An apparatus for flanging together metal sheets in a manufacturing process, said apparatus comprising:

a base frame having a tool pickup opening;

a flanging bed operative to move from a first position to a second position;

a flange drive device secured to said base frame and operative to move said flanging bed, said flanging drive device including a flanging lifter disposed upon spacing blocks secured to said base frame;

a flanging jack disposed upon said flanging bed;

an exchangeable flanging tool said tool including said flanging bed and said flanging jack, mounted on the base frame and being configured to be positioned through said tool pickup opening of said base frame, said flanging tool further including a base plate and a cover plate cooperating to form a locator detente, said base plate having an opening of at least the size of the flanging bed and the cover plate having an opening of at least the size of a workpiece;

a spindle stroke device operative to displace the flanging bed from a first position through a work stroke and being disposed upon a cushion system operative to produce a flanging work stroke, said cushion system including a plurality of compressed air cushions;

a flanging tool base including slidable members therein, said exchangeable flanging tool being disposed on said slidable members such that a first exchangeable flanging tool can be slidably removed and replaced by slidably moving a second exchangeable flanging tool into place; and a change table configured to receive said flanging tool and disposed adjacent to said base frame.

11. The apparatus of claim 10, wherein the base frame has a predetermined position for receiving the flanging bed therein, wherein the flanging tool can be removed independent of said flanging bed.

* * * * *